US008298464B2

(12) United States Patent
Takarada et al.

(10) Patent No.: US 8,298,464 B2
(45) Date of Patent: Oct. 30, 2012

(54) FABRIC FOR CLOTHING AND A PRODUCTION METHOD THEREOF

(75) Inventors: Hiromi Takarada, Mishima (JP); Yoshitaka Aranishi, Hiratsuka (JP); Shoko Mihara, Mishima (JP)

(73) Assignee: Toray Industries, Inc. (JP)

( * ) Notice: Subject to any disclaimer, the term of this patent is extended or adjusted under 35 U.S.C. 154(b) by 28 days.

(21) Appl. No.: 10/594,142

(22) PCT Filed: Mar. 24, 2005

(86) PCT No.: PCT/JP2005/005320

§ 371 (c)(1),
(2), (4) Date: Nov. 21, 2006

(87) PCT Pub. No.: WO2005/093139

PCT Pub. Date: Oct. 6, 2005

(65) Prior Publication Data

US 2007/0207315 A1 Sep. 6, 2007

(30) Foreign Application Priority Data

Mar. 26, 2004 (JP) ..... 2004-091137

(51) Int. Cl.
*D01D 5/08* (2006.01)
*D03D 15/00* (2006.01)
*D04B 21/00* (2006.01)

(52) U.S. Cl. ..... 264/172.17; 264/171.25; 264/173.12; 442/189; 442/190; 442/211; 442/304; 442/308

(58) Field of Classification Search ..... 442/189, 442/190, 211, 304, 308
See application file for complete search history.

(56) References Cited

U.S. PATENT DOCUMENTS

| | | | | |
|---|---|---|---|---|
| 5,685,832 | A * | 11/1997 | Chen et al. | 602/48 |
| 6,207,601 | B1 | 3/2001 | Maurer et al. | |
| 6,500,539 | B1 * | 12/2002 | Chen et al. | 428/364 |
| 6,984,631 | B2 * | 1/2006 | Aranishi et al. | 514/57 |

FOREIGN PATENT DOCUMENTS

| | | |
|---|---|---|
| EP | 1 335 045 | 8/2003 |
| JP | 51-70316 | 6/1976 |
| JP | 11-506175 T | 6/1999 |
| JP | 2004-27378 A | 1/2004 |
| JP | 2004-182979 | 7/2004 |

* cited by examiner

*Primary Examiner* — Lynda Salvatore
(74) *Attorney, Agent, or Firm* — DLA Piper LLP (US)

(57) ABSTRACT

A fabric consisting of a cellulose mixed ester fiber having an appropriate strength, fiber diameter, uniformity of fineness, and Tg, is used. A fiber consisting of 80 to 95 wt % of said cellulose mixed ester and 5 to 20 wt % of one or more water-soluble plasticizers selected from the group of polyethylene glycol, polypropylene glycol, poly(ethylene-propylene) glycol, and end-capped polymers produced from them, is produced and said water-soluble plasticizers are removed by aqueous treatment to improve the heat resistance and strength, thereby providing a fabric having beautiful appearance achieved by color development properties and uniform fineness.

5 Claims, 1 Drawing Sheet

[Title of the Document] Drawings
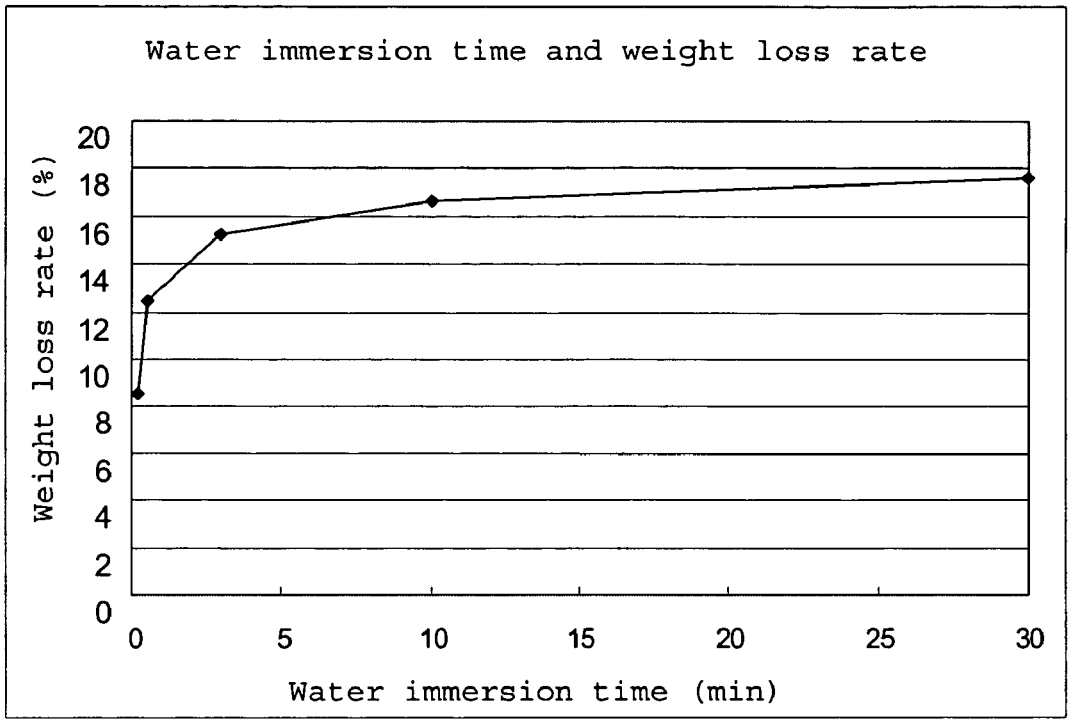

FABRIC FOR CLOTHING AND A PRODUCTION METHOD THEREOF

TECHNICAL FIELD

The invention relates to a fabric for clothing that, at least partly, comprises cellulose mixed ester fiber and a production method thereof.

BACKGROUND ART

Cellulose and cellulose derivatives including cellulose ester and cellulose ether are now attracting considerable attention because they are major biomass-based materials and also because they can be biodegraded in the environment. Cellulose acetate, which is a well-known commercially available cellulose ester, has been used for many years in producing cigarette filters and fiber materials for clothing. Other cellulose esters include cellulose acetate propionate, cellulose acetate butyrate, and cellulose acetate phthalate, which are used widely as material for plastics, filters and coatings.

As fiber material, cellulose has been used from old times in the form of spun fiber using short fiber of naturally grown cotton and hemp. Methods to produce filament material instead of short fiber include wet spinning, used for instance to dissolve cellulose such as rayon in a special solvent such as carbon disulfide, and dry spinning, used for instance to produce a cellulose derivative such as cellulose acetate which is then dissolved in an organic solvent such as methylene chloride or acetone, followed by spinning while evaporating the solvent, and furthermore, a method has been disclosed (see JP-51-70316 A 1) in which a cellulose acetate melt containing a large amount of water-soluble plasticizer such as polyethylene glycol is subjected to melt spinning to produce for hollow fibers to be used as filter membrane. The latter method, however, often suffers severance of yarns during the spinning process, and has to use a low draft ratio to permit melt spinning, making it impossible to produce fiber with a sufficiently small fineness for common clothing. The method generally can produce thick yarns such as for hollow filaments for filter membrane, but very low in strength, they are stiff, less flexible, and easily broken if a fabric is produced, so it will be extremely difficult to manufacture clothing and other common products that require both a small fineness and a high strength.

If a hollow fiber for filter is produced from cellulose acetate containing as large as 20% of plasticizer, small pores will grow in the fiber in a subsequent treatment with water or alkali. However, these large number of pores will further decrease the strength of the fiber, and tend to cause whitening due to abrasion and a decrease in fastness, which is another reason for inappropriateness as material for clothing which suffers continuous external forces during use.

Cellulose acetate material produced by dry spinning generally suffers a very large deformation of fibers as a result of evaporation of solvents from inside the fiber immediately after the spinning, leading to indefinite cross-sections. Thus, acetate fabrics are inferior to polyester and other melt-spun fabrics composed of uniform fiber with controlled cross-sections in that the former has uneven surface quality with irregular features.

It has also been disclosed (see JP-11-506175T) that the use of the melt blow method for spinning of cellulose ester permits the spinning of yarns with a small fineness. However, though fiber structures produced by melt blow are widely used as industrial nonwoven fabrics, their applications are essentially very limited because such fiber cannot serve for production of woven and knitted fabrics. Further, the melt blow method has essential difficulty in achieving a uniform fiber diameter, and the coefficient of variation (CV) in fineness, which represents the unevenness in fineness, is 30 to 40% in most cases, indicating that the thickness of single fibers varies largely.

Thus, fabrics composed of yarns tend to vary in cross-section and fineness of the fiber, and it is difficult to achieve a uniformity in glossiness resulting from reflection of light on the surface and a uniformity in color resulting from dyeing, leading to perceived unevenness.

It is known that thin yarns with a uniform fineness, such as those conventionally used in clothing, can be produced by melt spinning with a high productivity if using a composition prepared by kneading, at a specific mixing ratio, a cellulose mixed ester and a plasticizer that is compatible to said cellulose mixed ester (see JP-2004-182979 A1).

On the other hand, a cellulose mixed ester containing a plasticizer has a low glass transition point (Tg), and is so low in heat resistance for daily-use clothing that heating during ironing can cause fusion easily. Containing a plasticizer, moreover, the fiber is so low in strength that if clothing is produced from a fabric of such fiber, it will be low in strength and will be easily torn.

Concerning the quality of a fabric for clothing, it is important to meet the requirements for aesthetic appeal and texture as well as the basic physical properties such as strength and heat resistance during use.

Thus, fabrics with high heat resistance, good yarn properties and aesthetic appeal that can be used as material for general clothing cannot be produced easily by subjecting cellulose, a biomass-based material, to a melt spinning process that is free of environmentally harmful solvents.

DISCLOSURE OF THE INVENTION

It could therefore be helpful to provide a fabric comprising cellulose mixed ester fiber suitable for clothing that has high heat resistance and improved properties such as strength, and a production method thereof.

SUMMARY

We thus provide fabric for clothing of the invention at least partly comprises cellulose mixed ester fiber with a glass transition point (Tg) of 160° C. or more and a strength in the range of 1.3 to 4 cN/dtex. As a desired embodiment, it is preferred that the initial tensile modulus of the fiber is in the range of 30 to 100 cN/dtex, the CV in single fiber fineness being 10% or less, average single fiber diameter being in the range of 5 to 50 μm, the content of plasticizers in the fiber being in the range of 0 to 1.0 wt % relative to the weight of the cellulose mixed ester fiber, the total molecular weight of the acyl groups per glucose in said cellulose mixed ester being in the range of 120 to 140, and the degree of substitution being in the range of 2.6 to 2.8.

The production method of fabrics comprising cellulose mixed ester fibers is a production method of fabrics for clothing that at least partly comprises cellulose mixed ester fiber, wherein a composition consisting of at least 70 to 95 wt % of a cellulose mixed ester and 5 to 20 wt % of a water-soluble plasticizer is subjected to a melt-spinning process to produce a fiber of 5 to 50 μm, and after and/or before converting it into a form of fabric, said plasticizer is eluted out of the fiber by aqueous treatment.

Said water-soluble plasticizer may be one or more selected from the following group: polyethylene glycol, polypropylene glycol, poly(ethylene-propylene) glycol, and end-capped polymers produced from them, as represented by the general formula (I) described below.

$$R1\text{-}O\text{—}[(PO)n/(EO)m]\text{—}R2 \quad (1)$$

(In the formula, R1 and R2 represent the same group or different groups that may be H, alkyl, or acyl. Here, n and m represent an integer of 0 or more and 100 or less, and meet the following equation: $4 \leqq n+m \leqq 100$, while/indicates random- or block-copolymerized structure, and the structure is a homopolymer when either n or m is 0. Further, E represents $CH_2$—$CH_2$ and P represents $CHCH_3$—$CH_2$.) For the production method of fabric comprising cellulose mixed ester fiber, it is also preferred that the glass transition point (Tg) of the fiber after removing the plasticizer is 60° C. or more higher than that of the fiber before the removal of the plasticizer, and that the fiber strength after removing the plasticizer is 0.2 cN/dtex or more larger than that of the fiber before the plasticizer removal, and that 70% or more of said plasticizer in the fiber is removed within 5 minutes by said aqueous treatment, and that said plasticizer is removed with an aqueous treatment solution free of scouring agents, followed by treatment with a treatment solution that contains a scouring agent, and that said plasticizer removal by said aqueous treatment is carried out after converting the fiber into fabric.

We thus provide a fabric for clothing comprising heat-resistant fiber that is mainly composed of cellulose mixed ester produced from cellulose, a biomass-based material. Fabrics composed of cellulose mixed ester fiber with a high Tg and a high strength show good heat resistance, and no surface shine and fusion, and they have good properties such as strength required for clothing as well as moderate stiffness and tension, and also have aesthetic value-added properties such as high gloss, good color development properties, and perceived uniform fabric surface as well as moisture emission and absorption. With high gloss and vivid colors in particular, they can be very useful in the fields of fashionable clothing production. The production method uses environment-friendly, high-quality, melt-spun yams and elutes plasticizer easily during textile processing processes, to facilitate easy production of fabrics composed of heat-resistant cellulose mixed ester fiber.

BRIEF DESCRIPTION OF DRAWINGS

FIG. 1 shows changes in weight caused by aqueous treatment of the knitted fabric produced in Example 4 of the invention. Specifically, it illustrates the amount of the plasticizer eluted by the aqueous treatment.

DETAILED DESCRIPTION

The fabric for clothing at least partly comprises fiber that is mainly composed of cellulose mixed ester. With a fabric structure containing cellulose mixed ester fiber, the fabric for clothing produced has good properties such as moisture absorption, color development properties, and uniform gloss, as well as good mechanical characteristics.

Described below are cellulose mixed ester fiber to be used in the fabric for clothing, and fabrics that at least partly comprise said cellulose mixed ester fiber.

In the cellulose mixed ester, hydroxyl groups in the cellulose are esterified with two or more different acyl groups. There are no specific limitations on the method to produce the cellulose mixed ester, and a conventionally known method can be used.

Specifically, cellulose mixed esters that can be include cellulose acetate propionate, cellulose acetate butyrate, cellulose acetate capronate, cellulose acetate caprylate, cellulose acetate laurate, cellulose acetate palmitate, cellulose acetate stearate, cellulose acetate olate, cellulose acetate phthalate, and cellulose propionate butyrate. Among others, the cellulose mixed ester should be either cellulose acetate propionate or cellulose acetate butyrate, or both, because they are easy to manufacture and high in heat resistant.

The degree of substitution of said cellulose mixed ester is preferably 2.6 or more to prevent significant decrease in strength in a wet state. It is also preferably 2.8 or less to ensure a moderate hygroscopicity.

There are no specific limitations on the type and ratio of the substituents in the cellulose mixed ester, but the total molecular weight of the acyl groups per glucose unit can influence the hydrophilicity and hydrophobicity of the fiber. If the degree of substitution is 2.0 and 0.7 for the acetyl group with a molecular weight of 43 and for the propionyl group with a molecular weight of 57, respectively, with the remaining 0.3 representing the unsubstituted hydroxyl groups, then total molecular weight of the substituents is 126. If this total molecular weight of the substituents is less than 140, the cellulose mixed ester is not too high in hydrophobicity, allowing the fiber to have a moderate hygroscopicity, and the Tg is high enough to achieve a high heat resistant.

If for instance the cellulose mixed ester fiber used has a hygroscopicity of 4 to 6% at 20° C. and 65% RH, a fabric comprising 50 wt % or more of this fiber relative to the weight of the fabric, or 100 wt % relative to the fabric, will have a hygroscopicity suitable for clothing.

If the total molecular weight of the substituents is larger than 120, it works to prevent such behaviors as swelling with water and shrinkage by drying, and the fabric produced will have a high shape stability. It should more preferably be in the range of 120 to 135.

For the cellulose mixed ester fiber, it is important to have a glass transition point (Tg) of 160° C. or more. If Tg is 160° C. or more, the fabric containing said cellulose mixed ester fiber will not suffer undesired shine and fusion under hot pressing by ironing, suggesting that the fabric has a high heat resistance required for clothing material. To produce a fabric with a required heat resistance, said cellulose mixed ester fiber preferably has a glass transition point (Tg) of 170° C. or more, most preferably 180° C. or more.

It is important for the cellulose mixed ester fiber to have a strength in the range of 1.3 to 4 cN/dtex. If the strength is 1.3 cN/dtex or more, a fabric comprising the cellulose mixed ester fiber will have sufficiently large tear strength. A larger strength is better, but at the present time, it is difficult to achieve a strength of more than 4 cN/dtex. The strength of fiber is more preferably 1.5 cN/dtex or more, still more preferably 1.7 cN/dtex or more.

The initial tensile modulus of the cellulose mixed ester fiber should be in the range of 30 to 100 cN/dtex. If it is 30 cN/dtex or more, a fabric comprising the cellulose mixed ester fiber will have textural features such as moderate stiffness and tension, while if it is 100 cN/dtex or less, the fabric comprising the cellulose mixed ester fiber will have textural features such as moderate softness. To obtain fabric for clothing with textural features such as moderate softness, stiffness, and tension, the initial tensile modulus is preferably in the range of 35 to 90 cN/dtex, most preferably 40 to 80 cN/dtex.

The cellulose mixed ester fiber should have an average fiber diameter in the range of 5 to 50 μm. For the invention, the side faces of 20 filaments are observed with a scanning electron microscope, and the measured width of each filament in the direction perpendicular to the fiber axis is provided for the average fiber diameter calculation. In view of the texture of the fabric comprising said cellulose mixed ester, an average diameter of 5 μm or more is preferred to achieve a moderate fabric thickness. An average diameter of 50 μm or less is preferred to obtain a soft fabric. In view of the texture of the fabric, said cellulose mixed ester preferably has an average fiber diameter in the range of 10 to 45 μm, most preferably 15 to 45 μm.

The cellulose mixed ester fiber preferably has a CV (coefficient of variation) in single filament fineness of 10% or less. The CV in fineness is a parameter generally used to represent the variation in the fineness over the single filament that constitute multi-filaments, and calculated by the following equation (2) from the standard deviation and the average value of single filament diameter obtained by observing the side face of filaments with an electron microscope and measuring the width of the fiber filaments in the direction perpendicular to the fiber axis.

CV in fineness (%)=standard deviation of single filament diameters/average value of single filament diameters (equation 2)

The CV in fineness of polyethylene terephthalate fiber, for instance, produced by a common melt spinning process is 5% or less, while the CV in fineness is generally in the range of 30 to 40% for fiber produced by the melt blow process.

If the variation in the single filament fineness is small, with a CV in the single filament fineness of 10% or less, fabrics produced will have a perceived uniform surface with uniform gloss and color to allow the fabric for clothing to have a preferred beautiful appearance.

It is preferred that the cellulose mixed ester fiber is virtually free of pores. A pore is defined as an empty space with a major axis length of 0.01 to 2 μm existing within the fiber. For the invention, a fiber is deemed to be uniform and free of pores if only less than 5 such pores exist within the fiber when the cross-sections of 20 filaments are observed with an electron microscope. The hollow fiber for the filter has very large number of pores which are produced during the plasticizer removal. Such fiber can be a good material for filters, but is likely to suffer a decrease in strength and friction resistance depending on the size and number of the pores. The fiber for the invention is free of pores, and therefore the fabric produced from it will be high in frictional strength and will not suffer significant quality deterioration.

It is preferred that said cellulose mixed ester fiber accounts for 50 wt % or more of the fabric for clothing in order to prevent weakening of the advantageous effect. If said fabric contains 50 wt % or more of said cellulose mixed ester fiber, said fiber will have vivid colors and good chromogenic properties, in addition to surface gloss and beautiful uniform colors resulting from uniform yarn quality, leading to strong aesthetic appeal as material for fabrics for clothing. Moreover, said cellulose mixed ester fiber has a strength, heat resistance, hygroscopicity, and dimensional stability required for clothing, in addition to moderate stiffness and tension, and can be good material to produce suitable fabrics for clothing that have good texture.

A fabric produced by combining the cellulose mixed ester fiber with polyester fiber has high hygroscopicity and good color development properties, making up for polyester's faults. A fabric consisting of 50 wt % of the cellulose mixed ester and 50 wt % of polyester, for instance, can have a moisture absorption coefficient of 2% or more at 20° C. and 65% RH and also have improved black color development properties and vivid colors. With a high dimensional stability, it will have a performance suitable as a fabric for clothing.

A combination of the cellulose mixed ester fiber with cotton yarns achieves a shape stability and quick drying characteristics in addition to the hygroscopicity of cotton, and also obtain a moderate gloss, allowing the fabric to have both fashionable and functional features.

Described below is the production method of fabrics for clothing that at least partly comprises the cellulose mixed ester fiber.

The cellulose mixed ester fiber of the invention may be produced by the melt spinning of a composition at least consisting of 70 to 95 wt % of a cellulose mixed ester and 5 to 20 wt % of a water-soluble plasticizer.

Here, the cellulose mixed ester should account for 70 to 95 wt % of the entire composition. A content of 70 wt % or more means that the fiber contains a large amount of a high-strength component, serving to avoid troubles such as thread breakage during melt spinning. If the content of the cellulose mixed ester is 95 wt % or less, on the other hand, the composition has a high thermal flowability, leading to efficient yarn formation during melt spinning. The content of said cellulose mixed ester in the entire composition is more preferably in the range of 75 to 90 wt %, most preferably 80 to 85%.

If used alone, said cellulose mixed ester is poor in thermal flowability and cannot be melt-spun effectively. For melt spinning, a plasticizer may be added to increase the thermal flowability of the composition, but a cellulose mixed ester that contains a plasticizer has a lower glass transition point (Tg) of about 100° C., leading to a problem with heat softening if it is directly used to produce a fabric. The cellulose mixed ester fiber in the final fabric product should have a glass transition point (Tg) of 160° C. or more, and therefore it is important for said plasticizer to be a water-soluble compound that can be leached out easily by aqueous treatment. Here, a substance is deemed to be water-soluble if 1 wt % or more of it can dissolve in water at 20° C. A highly water-soluble substance that dissolves up to 5 wt % or more in water at 20° C. can be easily removed with water after fiber production, allowing the advantageous effect of the invention to be realized easily.

The content of said water-soluble plasticizer in the cellulose mixed ester composition is preferably in the range of 5 to 20 wt %. A water-soluble plasticizer content of 20 wt % or less serves to improve the melt spinning characteristics, decrease the frequency of yarn breakage during melt spinning, and to produce fiber with a moderate fineness and strength, which prevent pores from forming in the fiber during the aqueous treatment process for plasticizer removal, allowing the fiber to have a uniform structure. On the other hand, a water-soluble plasticizer content of 5 wt % or more leads to a high thermal flowability, which serves to use a lower spinning temperature to control the thermal decomposition of the composition, allowing the resulting fiber to have good color tone and mechanical characteristics.

Said water-soluble plasticizers is preferably one or more selected from the following group: polyethylene glycol, polypropylene glycol, poly(ethylene-propylene) glycol, and end-capped polymers produced from them, as represented by the general formula (1) described below.

$$R1\text{-}O\text{—}[(PO)n/(EO)m]\text{—}R2 \quad (1)$$

(In the formula, R1 and R2 represent the same group or different groups that may be H, alkyl, or acyl. Here, n and m represent an integer of 0 or more and 100 or less, and meet the following equation: $4 \leqq n+m \leqq 100$, while/indicates a random- or a block-copolymerized structure, but the structure is a homopolymer when either n or m is 0. Further, E represents $CH_2$—$CH_2$ and P represents $CHCH_3$—$CH_2$.) These plasticizers are preferred because they are high in compatibility with the cellulose mixed ester, serving to notably increase the thermal flowability of the composition during melt spinning and prevent the bleed-out from the fiber. There are no specific limitations on the molecular weight of said water-soluble plasticizer used for the invention, but it is preferably in the range of 200 to 1,000. A molecular weight in this range works to prevent the evaporation during the melt spinning process and to improve the compatibility with the cellulose mixed ester. The molecular weight of said water-soluble plasticizer is more preferably in the range of 300 to 800.

Said cellulose mixed ester composition may contain other compounds such as epoxy compounds, weak organic acids, phosphites, and thiophosphites, each of which may be used alone or two or more of which may be used in combination as required, as stabilizers for prevention of heat deterioration and coloring, as long as they do not cause damage to the required performance. There will be no problems if other additives including organic acid based biodegradation accelerators, lubricants, antistatic agents, dyes, pigments, lubricants, and delusterants are added.

When mixing the cellulose mixed ester with a plasticizer and other required additives, a common, known mixing instrument such as extruder, kneader, roll mill, and Banbury type mixer may be used without specific limitations. Said composition mainly composed of the cellulose mixed ester and said plasticizer is preferably pelletized with an extruder before feeding it to the melt spinning machine, or the extruder is preferably connected to the melt spinning machine via a pipe, in order to minimize the formation of babbles. Such a pelletized mixture is preferably dried before melt spinning down to a water content of 0.1 wt % or less in order to prevent the hydrolysis and babble formation during melting.

A composition containing at least the cellulose mixed ester and the water-soluble plasticizer will have a high thermal flowability, can be easily melt-spun into cellulose mixed ester fiber. Such melt spinning of cellulose mixed ester fiber may be carried out by feeding said cellulose mixed ester composition to a known melt spinning machine. For instance, said cellulose mixed ester composition may be melted by heating, and spun through a nozzle to produce a yarn, which is then taken up by a godet roller rotating at a constant rate and wound up in a package while being drawn or without being drawn. Melt spinning by this procedure serves to produce fiber with uniform shape and quaility. Said melt spinning is preferably performed at a temperature in the range of 200° C. to 280° C., more preferably 200° C. to 270° C. A spinning temperature of 200° C. or more works to decrease the melt viscosity and facilitate the melt spinning process. A spinning temperature of 270° C. or less serves to control the thermal decomposition of the cellulose mixed ester composition.

As described above, the cellulose mixed ester fiber preferably has a CV (coefficient of variation) in single filament fineness of 10% or less. The CV in fineness is a parameter generally used to represent the variation in the fineness over the single filament that constitute a multifilaments. The fabric production method contains a process for eluting water-soluble plasticizers from fiber, and therefore, a variation in the fineness of single filament will lead to uneven elution of the water-soluble plasticizers. Since this causes uneven dying of the fiber and an uneven heat resistant distribution, a smaller CV in fineness of the fiber is more preferred. Thus the CV in the fineness of single filament is preferably 10% or less, more preferably 5% or less. For the invention, a molten polymer may be spun through a nozzle and taken up by a godet roller to produce a uniform yarn with a CV in fineness of 10% or less.

For the fabric production method, it is important to carry out aqueous treatment for removal of plasticizers after producing the cellulose mixed ester fiber. The aqueous treatment means the procedure which is performed by immersing the fiber in a solution mainly composed of water. There are no specific limitations on the method to be used, and the fiber produced by melt spinning may be allowed to run continuously through a water bath, or said fiber may be shaped into cheese package followed by processing with a batch type cheese dyeing machine. After said shaping, or after fabric production, furthermore, similar continuous or batch type beam processing, or batch type aqueous treatment with a jet dyeing machine may be carried out.

There are no specific limitations on the solution to be used for said aqueous treatment, except that it is mainly composed of water. It may be simply water, or may be a water-based liquid containing additives designed to remove oils and sizing pastes, such as sodium carbonate, sodium hydroxide, and other alkaline compounds, or scouring agents such as non-ionic or anionic surface active agents.

If a plasticizer is added, the cellulose mixed ester fiber tends to adsorb highly lipophilic surface active agents, and therefore, it is preferred that water-soluble plasticizers are removed first by aqueous treatment without using scouring agents, followed by removal of oils and pastes by processing with an aqueous treatment by the solution containing a scouring agent.

Said aqueous treatment is preferably carried out at a temperature in the range of 15° C. to 80° C., more preferably 20° C. to 70° C. A treatment temperature of 20° C. or more allows plasticizers to be removed quickly, while a temperature of 70° C. or less is preferred to maintain the gloss of the fiber.

Said water-soluble plasticizers contained in the cellulose mixed ester fiber may be removed completely at one time by carrying out the treatment process, or in multiple steps for, for instance, removing part of them during yarn processing and removing the remaining plasticizers during scouring and dyeing of the fiber produced. The required treatment time for plasticizer removal depends on the type of treatment equipment used and the type of fiber structure such as yarn, cheese package and fabric, and an appropriate time can be determined on the basis of the capacity of equipment, workability and costs. The treatment time may vary from as short as 0.2 seconds to about one hour as required. It is preferred that cellulose mixed ester filaments constituting the fabric of the invention have an average diameter in the range of about 5 to 50 μm, because their large surface area serves for quick removal of water-soluble plasticizers, allowing 70 wt % or more of the plasticizer content to be removed within 5 minutes in most cases regardless of the treatment method used.

Said cellulose mixed ester fiber is characterized in that its glass transition point (Tg) is increased by removing the plasticizers. It is preferred that the rise in glass transition point (Tg) caused by plasticizer removal is 60° C. or more. If the glass transition point (Tg) increases by 60° C. or more, melt spinning can be performed before plasticizer removal, and naturally, the heat resistance improves after plasticizer removal, serving to prevent surface shine and fusion of fabric from being caused by heating under pressure such as ironing.

Said plasticizers should be removed as completely as possible in order to increase Tg by 60° C. or more. Tg increases with a decreasing content of plasticizers, and if their content is reduced to 1% or less, Tg will be higher by 60° C. or more compared to plasticizer-containing fiber.

Removal of said plasticizers allows the cellulose mixed ester fiber to increase in strength by 0.2 cN/dtex or more. This may be because pores are not formed in the fiber as a result of the elution of said plasticizers which are mixed with the cellulose mixed ester in a completely compatible way, and also because the removal of said plasticizers works to increase the density of the cellulose mixed ester which is the main component that develops strength.

The plasticizer is quickly removed by said aqueous treatment, but it is preferred that the final plasticizer content in the cellulose mixed ester fiber constituting the fabric is 0 to 1.0 wt % relative to the weight of the cellulose mixed ester fiber.

In the fabric production method, said water-soluble plasticizer elution process comprises aqueous treatment which may be carried out at a stage following the production of cellulose mixed ester fiber, at a stage following the production of fabric, and/or at a stage prior to the production of fabric.

In removing said plasticizers by said aqueous treatment, the strength of the fiber increases if it is under tension. For instance, it is possible to apply a certain degree of tension to the fiber if liquid bath drawing or cheese winding is performed in the yarn processing process. Weaving and knitting also applies a weak tension to the fabric by pulling different parts. The strength of the fiber increases if said plasticizers are removed under such tension. The strength of the cellulose mixed ester further increases if the tension applied to the fiber is 0.05 cN/dtex or more, while treatment can be performed without breaking the fiber if the tension is A×0.7 cN/dtex (where A represents the strength of fiber before plasticizer removal) or less. If the aqueous treatment process is performed by passing the fiber through the process after being converted into a fabric, handling will be easy and the fabric can be passed through the process smoothly, leading to a smaller increase in required cost and allowing the fiber to be treated under a weak tension.

Weaving and knitting of a fabric comprising the cellulose mixed ester fiber can be carried out by known methods. Specifically, it can be performed by using a weaving machine such as shuttle, rapier, air jet loom and water jet loom, or others such as flat knitting machine, circular knitting machine and warp knitting machine, any of which may be used to fit the purpose. A composite woven or knitted fabric may be produced by combining with another kinds of fibers. In such cases, twisted, woven or knitted union fabrics and blended yarn fabrics may be produced as required.

After removing plasticizers, a fabric comprising the cellulose mixed ester fiber of the invention may be dyed or finished with a conventional method. A fabric comprising the cellulose mixed ester fiber produced according to the invention has a large strength, and therefore, may be dyed with conventional jet, wince, jigger, and beam dyeing machines which are conventionally used for texturing process of fabrics. Since heat resistance is increased by plasticizer removal, furthermore, it is possible to carry out intermediate heat setting after scouring, and finish heat setting, so that clothing material with suitable texture and high-grade quality can be produced easily.

EXAMPLES

Our fabrics and methods are described more specifically below by using examples, though they are not intended to place any limitations on the invention. The degree of substitution, melt viscosity, fiber strength, initial tensile modulus, CV in filament fineness, fiber diameter, Tg, and thermal deformation of the cellulose mixed ester were determined as follows.

(1) Degree of substitution of cellulose mixed ester

The cellulose mixed ester is dried, and 0.9 g of it was weighed out, followed by addition and dissolution of 35 ml of acetone and 15 ml of dimethylsulfoxide, and addition of another 50 ml of acetone. While stirring, 30 ml of 0.5N sodium hydroxide was added and the solution was sapoinified for 2 hours. Then 50 ml of hot water was added to rinse the side wall of the flask, and the solution was titrated with 0.5N sulfuric acid using phenolphthalein as a indicator. Elsewhere a blank test was carried out by the same procedure. After the completion of the titration, the supernatant was diluted 100-fold, and the composition of the organic acid was analyzed by ion chromatography. The degree of substitution was calculated by the following equation from above measurements and composition analysis by ion chromatography.

$$TA=(B-A)\times F/(1000\times W)$$

$$DSace=(162.14\times TA)/[\{1-(Mwace-(16.00+1.01))\times TA\}+\{1-(Mwacy-(16.00+1.01))\times TA\}\times(Acy/Ace)]$$

$$DSacy=DSace(Acy/Ace)$$

TA: total volume of organic acid (ml)
A: volume of titrant for sample analysis (ml)
B: volume of titrant for blank test (ml)
F: titer of sulfuric acid
W: weight of sample (g)
DSace: degree of substitution of acetyl group
DSacy: degree of substitution of propionyl group or butyryl group
Mwace: molecular weight of acetic acid
Mwacy: molecular weight of propionic acid or butyric acid
Acy/Ace:mole ratio of propionic acid (Pro or butyric acid (Bt) to acetic acid (Ac)
162.14: molecular weight of cellulose repeating unit
16.00: atomic weight of oxygen
1.01: atomic weight of hydrogen (2) Strength and Initial Tensile Modulus Tensilon UCT-100, supplied from Orientec Co., Ltd, was used to perform a tension test under the conditions of a specimen length of 20 cm and a stretching rate of 20 mm/min, the stress observed at the maximum load point was taken as the strength (cN/dtex) of the fiber. The initial tensile modulus was calculated according to JIS L 1013 (1999) (chemical fiber filament yarn testing method) 8.10 (initial tensile modulus).

(3) Weight Loss Rate

The sample was weighed after being dried in a hot air dryer at 60° C. for 3 hours, and the proportion of the weight difference between before and after the processing relative to the weight before the processing was calculated to determine the weight loss in percentage.

(4) Heat Resistance

A fabric sample was put between polyimide sheets (Kapton® supplied from Du Pont-Toray Co., Ltd.), heated by 10° C. at a time and pressed for 15 seconds by a hot-press while observing the deformation of the fabric sample. The sample was heated until the fiber in the fabric starts to deform and develops surface shine, and the limit temperature immediately before the start of deformation was determined to evaluate its heat resistance.

(5) Texture

The texture of the fabric obtained was evaluated by sensory test. Samples that feel soft enough for clothing, a little stiff, and too stiff for clothing were rated to 3, 2, and 1, respectively. Fabrics rated 3 are preferred, those rated 2 tolerable, and those rated 1 unsuitable.

(6) Average Fiber Diameter

From the fabric, 20 cellulose mixed ester filaments were taken and their side faces were observed by scanning electron microscopy, followed by calculation of the average of the measured widths in the perpendicular direction to the fiber axis.

(7) CV in Filament Fineness

The coefficient of variation (CV) was calculated from the standard deviation and the average of the diameters of said 20 filaments by the following equation: coefficient of fineness CV (%)=(standard deviation/average×100).

(8) Tg

A fiber sample was heated at a rate of 20° C. per minute, and the calorific value was measured by differential scanning calorimetry to produce an endothermic curve, from which the glass transition point Tg was determined.

(9) Existence of Pores

From a fiber specimen embedded in epoxy resin, ultra-thin sections were prepared with a cryomicrotome and observed by transmission electron microscopy to determine where pores with a length of 0.01 to 2 μm exist in the fiber. It was judged that pores existed if 5 or more said pores were found.

Example 1

First, 240 parts by weight of acetic acid and 67 parts by weight of propionic acid were added to 100 parts by weight of cellulose (supplied by Nippon Paper Industries Co., Ltd., dissolving pulp, α-cellulose 92 wt %), and mixed at 50° C. for 30 minutes. Cooling the mixture produced to room temperature, 172 parts by weight of acetic anhydride and 168 parts by weight of propionic anhydride cooled in an ice bath were added as esterifying agents, and 4 parts by weight of sulfuric acid was added as esterifying catalyst, followed by stirring for 150 minutes to ensure esterification. If the temperature reaches 40° C. during the esterification reaction, the mixture was cooled in a water bath. After the reaction has been almost completed, a mixture of 100 parts by weight of acetic acid and 33 parts by weight of water, used as a reaction terminator, is added little by little over a period of 20 minutes to hydrolyze the excess anhydride. Then, 333 parts by weight of acetic acid and 100 parts by weight of water were added, and the solution was stirred at 80° C. for 1 hour. After the completion of the reaction, a solution containing 6 parts by weight of sodium carbonate was added, and the cellulose ester precipitated was separated out by filtration, followed by rinsing with water and drying at 60° C. for 4 hours. The resulting cellulose mixed ester had a degree of substitution of 2.6 (acetyl group 1.9, propionyl group 0.7), and a weight average molecular weight of 120,000. From the degree of substitution and the proportions of the substituent groups, the total molecular weight of the acyl groups per glucose unit was calculated at 122.

A biaxial extruder was used to knead a mixture consisting of 85 wt % of cellulose mixed ester and 15 wt % of polyethylene glycol with an average molecular weight of 800 at 220° C., which was then cut into pieces of about 5 mm to produce pellets of a cellulose fatty acid ester composition.

These pellets were vacuum-dried at 80° C. for 8 hours, then melted at 250° C., fed into a melt spinning pack at a spinning temperature of 255° C., and spun through a nozzle with 24 holes with a 0.25 mm diameter and a 0.50 mm length at a discharge rate of 15.0 g/min. The spun yarn was passed though a heating cylinder (100 mm long) installed below the nozzle (temperature immediately below nozzle 240° C.), and cooled in a wind from a chimney with a wind flow rate of 0.3 m/sec. After adding oil to ensure settlement, the yarn was taken up by the first godet roller rotating at 1,500 m/sec, and then, via the second godet roller rotating at the same speed as the first godet roller, wound up on a winder rotating at a speed that allows the tension to be 0.1 cN/dtex. The fiber produced (100 dtex, 24 filaments; single fiber fineness. 4.2 dtex) had a strength of 1.4 cN/dtex.

The fiber produced was wound into a cheese package with a yarn tension of 15 cN, and rinsed with water at 40° C. for 5 minutes using a cheese dyeing machine to remove the plasticizer. Following the plasticizer removal, the fiber was dried at 60° C. The rate of weight loss caused by drying was 14.5%. The plasticizer removal rate was 96.7%, and the remaining plasticizer accounted for 0.5% of the total weight of the fiber. The average fiber diameter was determined to be 20 μm, and the CV in fineness was calculated from the fiber diameter at 3%. The fiber strength was 1.6 cN/dtex, which was larger than it had been before plasticizer removal. The fiber initial tensile modulus was 35 cN/dtex. The fiber Tg after the plasticizer removal was 185° C. An interlock knitted fabric was produced from the fiber using a 24 gauge weft knitting machine.

The heat resistant properties of the knitted fabric were studied. Results obtained are shown in Table 1. The knitted fabric was not fused and maintained a sufficiently high flexibility at a temperature as high as 170° C. Further, the knitted fabric had beautiful appearance with vivid colors, good gloss, and luster.

Example 2

The same fiber (100T-24f) consisting of a cellulose mixed ester and a plasticizer as in example 1 was used as warp while a polyester fiber (50T-22f) was used as weft in an air jet loom to produce a five-fold satin fabric.

The satin fabric was rinsed with water at 60° C. for 5 minutes to remove the plasticizer, and scoured to remove oil and other stains. This rinsing and scouring worked to decrease the weight of the satin fabric by 15.1%. Oil had been added up to 0.2% or more, indicating that the content of the plasticizer decreased by 14.9% or more. The plasticizer remaining in the fiber was estimated to be less than 0.1%.

Moreover, after performing intermediate setting at 160° C., the fabric was dyed at PH 5 by a conventional method using a jet dyeing machine.

Cibacet Scarlet EL-F2G 0.5% owf (supplied by Ciba Specialty Chemicals K.K.)

After the dying, RC washing was carried out under the following conditions.

sodium carbonate 1 g/l hydrosulfite 2 g/l

Softanol EP12030 (supplied by Nippon Shokubai Co., Ltd.) 0.2 g/l

Further, finish setting was carried out at 150° C. after the drying.

The content of the cellulose mixed ester fiber in the satin fabric was 66%.

Warp samples were taken from the satin fabric produced and their fiber diameter was determined by electron microscopy, showing that the average fiber diameter of the cellulose mixed ester fiber was 19 μm and that the CV in fineness was 3%.

The Tg of the warp sample was 185° C. Further, the physical properties of the yarn were observed, showing that its strength and the initial tensile modulus were 1.65 cN/dtex and 38 cN/dtex, respectively.

For the appearance quality, the fiber had a high gloss, vivid colors and uniformity in quality, producing a texture with a moderate stiffness and tension.

Moreover, the warp of the fabric was a tear strength of 1200 g. The coefficient of moisture absorption at 20° C. and 65% RH was 3% and the heat resistant temperature was 180° C. or more, allowing the fiber to be free of undesired shine and fusion when being ironed.

Comparative Example 1

The same procedure as in example 1 was carried out except that the plasticizer was not removed, and the interlock knitted fabric produced, which was used for comparative example 1, was examined to determine its heat resistance. Results are shown in Table 1. When heated at 110° C., this knitted fabric suffered fusion and partial deformation, and altered into film.

Comparison between the fiber in example 1 and that in comparative example 1 shows that the plasticizer removal served to improve the fiber strength by 0.3 cN/dtex in example 1 and increase the glass transition point, Tg, by 70° C. Then, the cross sections of the fiber samples produced in examples 1 and 2 and comparative example 1 were observed. All of the samples produced in examples 1 and 2 and comparative example 1 were had a circular cross section and had no pores inside. Results are shown in Table 1.

Example 3

The same procedure as in example 1 was carried out to produce pellets except that 90 wt % of a cellulose acetate butyrate produced by using butyric acid instead of propionic acid was adopted as said cellulose mixed ester and that 10 wt % of polyoxyethylene distearate was used as plasticizer. A yarn was spun as in example 1 from the pellets produced. The yarn showed a good thinning behavior and left no residues on the nozzle. No fuming was seen, and breakage of the yarn did not take place during spinning. Thus, the composition showed very good yarn formation properties. The fiber produced had a strength of 1.2 cN/dtex and an elongation of 26%.

The fiber obtained was then used as warp to produce a plain weave gray fabric with a rapier loom. The fabric was rinsed with a jet dyeing machine at 60° C. for 10 minutes to remove the plasticizer, and washed in a scouring liquid containing a scouring agent and sodium carbonate at 70° C. for 10 minutes to remove paste and oil. The strength after the souring was 1.6 cN/dtex, which was larger by 0.4 cN/dtex than before the scouring. The glass transition point, Tg, was measured before and after the elution of the plasticizer, and results showed that Tg after the elution was 180° C. while it was 113° C. before the elution. This scoured plain weave fabric was subjected to intermediate setting at 150° C., and dyed at 98° C. for 60 minutes according to the following procedure at PH 5 with a conventional method using a jet dyeing machine.

Cibacet Black EL-FGL 7% owf (supplied by Ciba Specialty Chemicals K.K.)

After the dying, RC washing was carried out under the following conditions.

sodium carbonate 1 g/l hydrosulfite 2 g/l

Softanol EP12030 (supplied by Nippon Shokubai Co., Ltd.) 0.2 g/l

The dyed fabric was broken apart and physical properties of the yarn were examined. The strength was 1.5 cN/dtex, and the initial degree of tensile resistance was 39 cN/dtex. The average fiber diameter was 21 μm, and the CV in fineness was 4%.

The tear strength of the dyed fabric was 1300 g, and its coefficient of moisture absorption was 4% at 20° C. and 65% RH. It was free of undesired shine and fusion when being ironed at 150 to 170° C.

The dyed fabric was light, and had a gloss and smooth surface, and therefore, it was suited as material for lining of clothing. Sensory test was carried out on 10 testees, and based on the average of results, the fabric was evaluated as "3" which indicated that the fabric had a good texture.

Example 4

The same procedure as in example 1 was carried out except that the ratio of acetic acid and propionic acid changed, and a cellulose acetate propionate with a degree of substitution of 2.8 (acetyl group 1.5, propionyl group 1.3) was produced as said cellulose mixed ester. The total molecular weight of the acyl groups per glucose unit was 139. To produce pellets, the same procedure as in example 1 was carried out except that 82 wt % of this cellulose acetate and 18 wt % of polyethylene glycol (molecular weight 600), adopted as plasticizer, was used. When the pellets were melt-spun, the resulting yarn showed a good thinning behavior and left no residues on the nozzle. Though a little fuming was seen, breakage of the yarn did not take place during spinning. Thus, the composition showed very good yarn formation properties. The fiber produced had a strength of 1.3 cN/dtex and an elongation of 28%.

A tubular knitted fabric produced from this fiber was immersed in water at 60° C. for a specified period of time, and after being taken out, examined to determine the changes in weight caused by the water treatment. Results are shown in Table 1. The decrease in weight was due to the elution of the plasticizer which accounted for 18 wt % of the fiber, suggesting that more than 80% of the plasticizer was removed in 3 minutes. The average fiber diameter was 30 μm. The strength was 1.5 cN/dtex, which was larger than the value observed before the plasticizer removal. The initial degree of tensile resistance was 35 cN/dtex.

Tg was measured before and after the plasticizer removal. It was found that Tg before and after the plasticizer removal was 100° C. and 170° C., respectively, suggesting that Tg increased by 70° C. Results are shown in Table 1.

Example 5

The same tubular knitted fabric as in example 4 was put in a solution at 60° C. containing 0.5 g/liter of a Softanol EP12030 nonionic surface active agent, and after stirring for 30 minutes, the change in weight was measured. Whereas the sample treated for 30 minutes in example 4 lost weight by 17.6%, the sample in example 5 lost 14.2% of its weight. The fact that the latter is smaller suggests that part of the material was absorbed by the surface active agent. However, both the heat resistance and the strength did not differ from those in example 4. Results are shown in Table 1.

Comparative Example 2

The same procedure as in example 1 was carried out to produce pellets except that as in example 4, 70 wt % of cellulose acetate propionate was used with 30 wt % of polyethylene glycol (molecular weight 800) as plasticizer, and melt spinning was carried out to produce fiber. The fiber obtained had a strength of 0.6 cN/dtex, which was so small that knitting was difficult. A skein of this fiber was immersed in warm water at 60° C., stirred slowly for 30 minutes to remove the plasticizer, and after being taken out, examined to determine the change in weight, showing that the weight loss was 28.2 wt %. The plasticizer removal rate was 94%. The average fiber diameter was 30 μm. The strength after the plasticizer removal was as small as 0.7 cN/dtex. Measurements were made of Tg before and after the elution of the plasticizer, and it was shown that whereas Tg before the plasticizer removal was 90° C., Tg after the removal was 185° C., suggesting that Tg increased by 95° C. Pores were seen in cross sections of the fiber produced when observed by SEM. A rapier loom was adjusted to a low strength yarn, and the fiber obtained and polyester were used as warp and weft, respectively, to produce a plain weave. The tear strength of the warp of the weave was as small as 450 g, and it can be torn easily by hand, suggesting that a fabric with such a strength would not serve as material for clothing. Results are shown in Table 1.

Comparative Example 3

The same procedure as in example 1 was carried out to produce pellets and melt-spin a yarn except that 70 wt % of cellulose diacetate with a degree of substitution of 2.4 was used with 30 wt % of polyethylene glycol (molecular weight 600) as plasticizer. However, the melt viscosity was so high and the flowability was so low that the yarn during spinning did not become thinner and could not be taken up. Thus the draft of the spinning machine was lowered to produce fiber with a larger diameter than in example 1. The strength of the fiber was 0.3 cN/dtex. An attempt was made to produce a knitted fabric from this fiber, but the single yarn was so thick that the yarn often breaks at the bend section, and it was difficult to produce a knitted fabric. A skein of this fiber was prepared and immersed, in warm water at 70° C. for 2 hours to remove the plasticizer. The weight loss caused by the treatment was 25.8%, and the plasticizer removal rate was 86%. The average fiber diameter was 70 μm. Observation of cross sections of the fiber produced showed that many pores were seen in the cross sections. The fiber after the plasticizer removal had a strength as small as 0.4 cN/dtex, and was so small in abrasion resistance that fibrillation easily took place. Results are shown in Table 1.

Comparative Example 4

The same procedure as in example 1 was carried out to produce pellets except that as in example 4, 75 wt % of cellulose acetate propionate was used with 25 wt % of polyethylene glycol (molecular weight 800) as plasticizer. The pellets were spun by the melt blowing method in which the fiber produced was drawn in a high-temperature, high-pressure air flow blown to the nozzle, followed by splitting and formation of a sheet.

The plasticizer was removed from the nonwoven fabric produced by melt blowing according to the same procedure as in example 2. The fabric was set at 160° C. and dyed with a pot type dyeing machine according to the same procedure as in example 2.

Microscopic observation of the fiber in the nonwoven fabric showed that there was a large variation in the fiber diameter. The CV in fineness was as large as 30%, and the average fiber diameter was 7 μm.

The surface of the dyed nonwoven fabric had uneven colors due to a variation in fiber fineness, resulting in lack of uniform appearance. With a high density, the nonwoven fabric seemed to be suitable as material for disposable products, but did not have high appearance quality for general clothing.

TABLE 1

| | Polymer | Substitution degree | Total molecular weight of substituents | Plasticizer removal method | Strength (cN/dtex) | Initial tensile modulus (cN/dtex) | Average single fiber diameter (μm) | CV in fineness (%) | Heat resistance (° C.) | Tg (° C.) | Fiber cross section | Others |
|---|---|---|---|---|---|---|---|---|---|---|---|---|
| Example 1 | CAP | 2.6 | 122 | Removed from yarn in cheese | 1.6 | 35 | 20 | 3 | >180 | 185 | Free of pores | |
| Example 2 | CAP | 2.6 | 122 | Removed from fabric | 1.65 | 38 | 19 | 3 | >180 | 185 | Free of pores | |
| Comparative example 1 | CAP | 2.6 | 122 | Not removed | 1.4 | 18 | 22 | 3 | <110 | 115 | Free of pores | Not heat resistant |
| Example 3 | CAB | 2.6 | 131 | Removed from cloth with jet dyeing machine | 1.6 | 39 | 21 | 4 | >170 | 180 | Free of pores | Good texture |
| Example 4 | CAP | 2.8 | 139 | Removed from yarn in tubular knitted fabric | 1.5 | 39 | 30 | 3 | >160 | 170 | Free of pores | |
| Example 5 | CAP | 2.8 | 139 | Removed with solution of surface active surfactant | 1.5 | 39 | 30 | 3 | >160 | 170 | Free of pores | |
| Comparative example 2 | CAP | 2.8 | 139 | Removed from yarn in skein | 0.7 | 30 | 30 | 5 | >160 | 170 | Pores found | Insufficient strength |
| Comparative example 3 | CDA | 2.4 | 103 | Removed from yarn in skein | 0.4 | 20 | 70 | 5 | >180 | 198 | Pores found | fine size difficult |
| Comparative example 4 | CAP | 2.8 | 139 | Removed from nonwoven fabric | — | — | 7 | 30 | >160 | 170 | Free of pores | Nonwoven fabric |

CAP: cellulose acetate propionate
CAB: cellulose acetate butyrate
CDA: cellulose diacetate

INDUSTRIAL APPLICABILITY

We provide a fabric comprising heat-resistant fiber consisting mainly of a cellulose mixed ester produced from cellulose, which is a biomass-based material. The fabric comprising cellulose mixed ester fiber has a gloss and vivid colors and serves preferably in the fashionable apparel manufacturing industry.

The invention claimed is:

1. A woven fabric or a knitted fabric for clothing at least partly comprising melt spun cellulose acetate propionate continuous filaments that contain no plasticizer and have a glass transition point (Tg) of 160° C. or more, a strength of 1.5 to 4 cN/dtex and a coefficient of variation in single yarn fineness of 10% or less.

2. The fabric for clothing according to claim 1, wherein the initial tensile modulus of said cellulose acetate propionate continuous filament is in the range of 30 to 100 cN/dtex.

3. The fabric for clothing according to claim 1, wherein the average single diameter of said cellulose acetate propionate continuous filament is in the range of 5 to 50 μm.

4. The fabric for clothing according to claim 1, wherein the average single fiber diameter of said cellulose acetate propionate continuous filament is in the range of 10 to 50 μm.

5. The fabric for clothing according to claim 1, wherein the cellulose acetate propionate continuous filament comprises glucose molecules having acyl units, and wherein the total molecular weight of the acyl groups per glucose unit in said cellulose mixed ester is in the range of 120 to 140 and the degree of substitution is in the range of 2.6 to 2.8.

* * * * *